US005357999A

United States Patent [19]

Loth et al.

[11] Patent Number: 5,357,999

[45] Date of Patent: Oct. 25, 1994

[54] SUBSEA CONTROL SYSTEMS AND APPARATUS

[76] Inventors: William D. Loth, Agars Plough, Margery Lane, Lower Kingswood, Surrey, KT20 7BP; Dennis S. Dowdall, 31 Arundel Avenue, Morden, Surrey, SM4 4DR, both of England

[21] Appl. No.: 924,078

[22] PCT Filed: Mar. 28, 1991

[86] PCT No.: PCT/GB91/00490

§ 371 Date: Sep. 21, 1992

§ 102(e) Date: Sep. 21, 1992

[87] PCT Pub. No.: WO91/15692

PCT Pub. Date: Oct. 17, 1991

[30] Foreign Application Priority Data

Mar. 30, 1990 [GB] United Kingdom ..... 9007210

[51] Int. Cl.[5] ..... F16K 17/36

[52] U.S. Cl. ..... 137/81.2; 137/236.1; 251/30.01; 251/61; 251/62

[58] Field of Search ..... 137/81.2, 236.1; 251/63.6, 63.5, 30.01, 31, 61, 62

[56] References Cited

U.S. PATENT DOCUMENTS

| | | | |
|---|---|---|---|
| Re. 30,115 | 10/1979 | Herd et al. | 137/236.1 X |
| 3,212,516 | 10/1965 | Natho | 137/236.1 X |
| 3,467,129 | 9/1969 | Gratzmuller | 137/236.1 |
| 3,677,001 | 7/1972 | Childers et al. | 137/81.2 X |
| 3,913,883 | 10/1975 | Irwin | 137/236.1 X |
| 3,933,338 | 1/1976 | Herd et al. | 251/63.6 |
| 4,095,421 | 6/1978 | Silcox | 137/81.2 X |
| 4,294,284 | 10/1981 | Herd | 137/81.2 X |
| 4,311,297 | 1/1982 | Barrington | 137/236.1 X |
| 4,337,829 | 7/1982 | Banzoli et al. | 137/236.1 X |
| 4,650,151 | 3/1987 | McIntyre | 137/81.2 X |
| 4,809,733 | 3/1989 | Hawkins | 137/236.1 |

*Primary Examiner*—John Rivell

*Attorney, Agent, or Firm*—Watson, Cole, Grindle & Watson

[57] ABSTRACT

A subsea actuator for operating a valve (20) or the like comprises a movable wall member (19) fixed to an axially slidable stem and separating a pressure chamber (2) from a space (3) which is subjected to the hydrostatic pressure of ambient seawater. A selector valve (11) is operable to connect the chamber (2) to a source of pressurised fluid, e.g. a source of pressurised gas (14), or to a drain e.g. connected to atmosphere by a pressure vessel (12) and pipe (15). A blowdown valve (16) and dump valve (13) are provided for ejecting liquid collected in the vessel (12). The space (3) may be connected to an open-bottomed container (17) to provide a gas barrier between the seawater and the interior of the actuator. Supply of pressurised gas to the chamber (2) causes the member (19) to be driven forwards, gas being allowed to flow past the member into the space (3) during this movement to assist the expulsion of water from the container (17) and the expulsion of any contaminants from within the actuator. When the chamber (2) is connected to atmospheric pressure the hydrostatic pressure of the seawater causes the member (19) to be driven in the reverse direction.

21 Claims, 6 Drawing Sheets

SUBSEA CONTROL SYSTEMS AND APPARATUS

This invention relates to control systems and apparatus for opening and closing valves on subsea installations associated with oil and gas production from subsea locations.

The Prior Art

Hitherto, subsea valves have been operated manually by divers, power operated by manned or unmanned submersible vehicles, or remotely actuated by means of integral valve actuators and control systems utilising mineral oil or specially formulated water-based solutions as the power fluid.

The remotely actuated systems are to a large extent versions of conventional surface equipment adapted for marine use and they have the disadvantage that to provide reliable operation in an environment of corrosive seawater which contains particulate matter and fosters biological activity, it is necessary to isolate internal components from seawater and utilise specialised power fluids with correct levels of additives. These power fluids tend to be expensive and the additives, or base constituents, often are environmentally deleterious. A further disadvantage of existing systems is the need to supply, or resupply, suitable power fluids. These drawbacks have inhibited the development of subsea closed loop control systems.

SUMMARY OF THE INVENTION

The aim of the present invention is to eliminate, or at least substantially alleviate the drawbacks of the prior art subsea valve actuators, and in accordance with the invention there is provided a subsea actuator for operating a subsea component such as a valve or similar linearly operated device, comprising a housing, a movable wall member cooperating with the housing to confine therewith a substantially closed chamber separated by the movable wall member from another fluid space, the wall member being fastened to an elongate output member and being movable under forces acting against the opposite sides thereof to displace the output member longitudinally, and inlet means to connect the chamber to either a source of pressurised fluid at a pressure greater than the hydrostatic pressure of the ambient seawater, or to drain outlet at a pressure not greater than the hydrostatic pressure of the ambient seawater, the actuator being arranged for the other space to be at the hydrostatic pressure of ambient seawater and the movable wall to be moved in a forward direction when the chamber is connected to the source of pressure fluid and to be moved in a reverse direction when the chamber is connected to the drain outlet.

A control system based on an actuator in accordance with the invention may use untreated seawater and a pressurised fluid preferably obtained from a subsea source and possibly also untreated sea water as the power mediums, whereby the sea-bed hydrostatic pressure at least contributes to the production of a force acting on the movable wall member to displace it, such as for actuating a valve. The pressurised fluid may be a low density fluid (gas), seawater pumped to a pressure above the ambient hydrostatic pressure of the actuator or could be taken from a well stream to which the valve being controlled is fitted. The control system will include a valve for selectively connecting the chamber of the actuator to the source of pressurised fluid or to a drain. When seawater is utilised as the pressure fluid the drain can lead directly to the surrounding seawater, but in this case the actuator will require an additional component such as a spring for driving the movable wall to produce a rearward stroke of the output member as the movable wall will be exposed to the hydrostatic pressure of the ambient seawater on both sides. The pressurised fluid can by a low density fluid, including gases. If gas is used as the pressurised fluid, the drain may be led to a level above the sea surface, preferably via a closed pressure chamber to accelerate actuator operation, so that the seawater pressure in the other space may be solely responsible for the rearward displacement of the movable wall member when the chamber is connected to the drain.

The other space, which is preferably another chamber in the housing, may be arranged to be flooded with seawater, but in an alternative embodiment the actuator is equipped with means to provide a gas barrier between the interior of the actuator and the surrounding sea, which can help minimise corrosion and biological activity and may in addition provide a visual indication of faults occurring or developing in the system. The means providing the gas barrier may be a container connected to an outlet orifice of the actuator at the upper end of the container and open to the sea at the lower end, the container being of greater volume than the total swept volume of the actuating actuator, and the gas trapped in the container forming a fluid barrier between the system internals and the sea, due to the different densities of the operating gas and seawater.

The component parts of the actuator according to the invention, and the other devices included in the subsea control system, will be constructed and manufactured from suitable materials consistent with exposure to untreated seawater and the subsea environment. The movable wall of the actuator may be constructed to provide a leakage flow from one chamber to the other chamber during movement of the wall member from a rearmost position to a forwardmost position, which can secure the advantage of flowby deterring accumulation of biological and other deposits within the actuator.

In one of the preferred embodiments of the invention it is preferred that the system operates with compressed gas in contact with the system internals, but inadvertent flooding of the control system with seawater (always a possibility due to damage) will not render the system inoperative as provision is made for the ejection of unwanted fluids and gas flushing through gas being allowed to flow past the movable wall member.

It will be understood that the actuator of the invention constitutes a thrusting device which is mounted on or adjacent to a process valve or similar mechanism being controlled. The movable wall member forms a thrust-producing member which is attached to an output member, conveniently an axially slidable stem. The actuator housing and movable wall member define a pressure containment means such that when a pressure higher than the seabed ambient is applied, the device will stroke in one direction, referred to as the forward direction, displacing fluid on the other side of the thrust-producing member in doing so, and when pressure not greater and preferably lower than the seabed ambient is applied, the device will stroke in the other, rearward direction under the influence of the higher surrounding hydrostatic pressure, possibly aided by a spring force.

A lower operating pressure less than seabed ambient may be obtained by connecting the internal volume of the thrusting device, via a selector valve, to a conduit or pressure vessel maintained at or near to atmospheric pressure by direct conduit connection to a point above the sea surface. The higher operating pressure may be obtained from a surface installation or subsea source connected to the selector valve.

A conduit or pressure vessel, within which solenoid or pilot valves can be contained and which is connected to the surface installation can be provided with a non-return dump valve to enable any collected fluids to be ejected to the sea when the conduit or vessel is temporarily pressurised above the surrounding seabed hydrostatic pressure. This device enables the control system to be kept serviceable irrespective of seawater ingress into the system.

With a control system as described herein a switching device at the control point enables the process valve to be opened or closed when required.

Some specific embodiments of the invention will now be described in detail, by way of example, with reference to the following drawings.

DETAILED DESCRIPTION OF THE PREFERRED EMBODIMENTS

Figure 1:
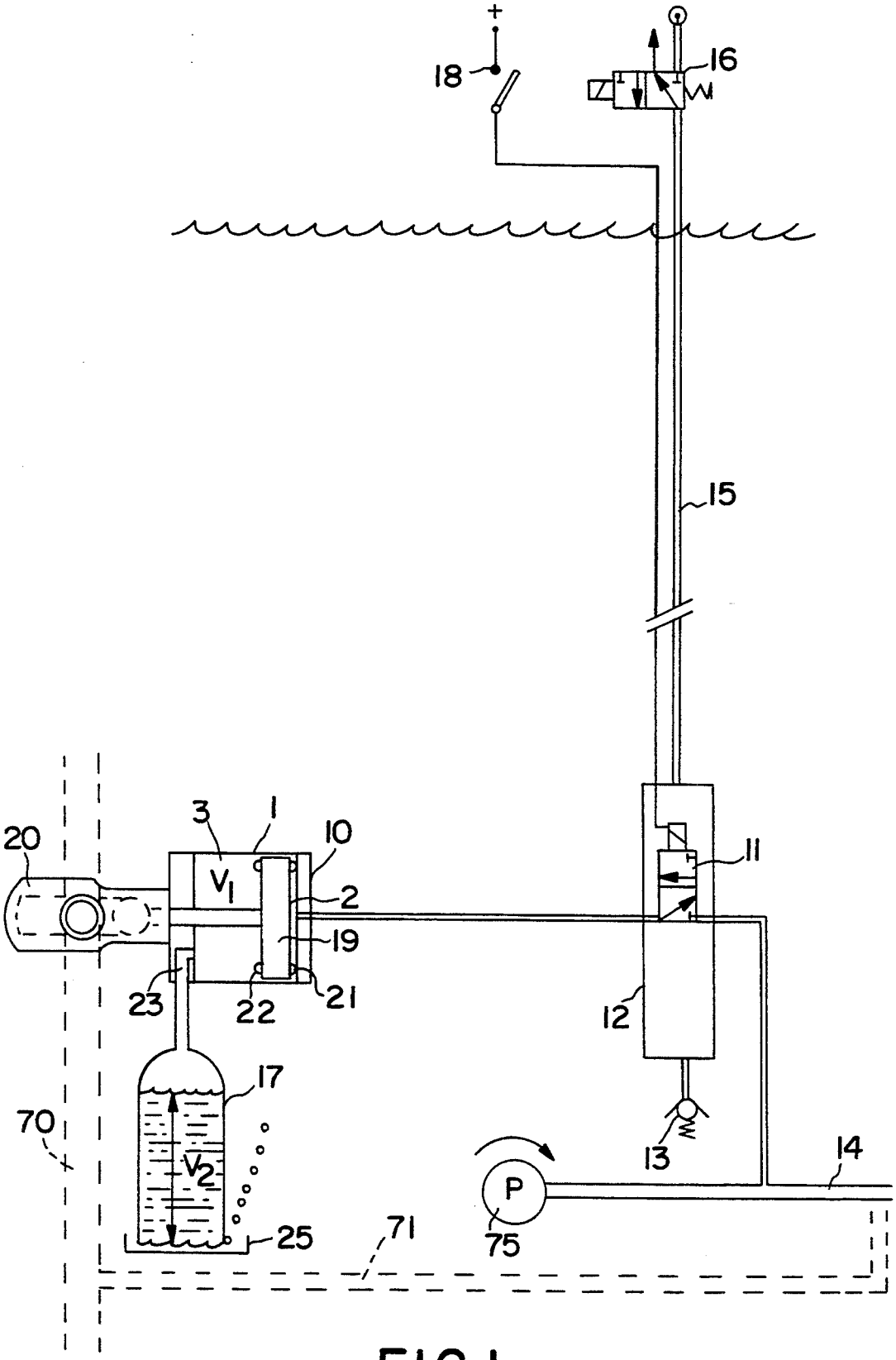
FIG. 1 shows a typical schematic layout of the overall control system.

In FIG. 1 there is shown a subsea valve control system, the principal components of which are a thrusting device (valve actuator) 10, a fluid or, as shown, electrically-operated selector valve 11, a pressure vessel 12, a non-return dump valve 13, a source 14 of high pressure low density fluid which in the particular example is gas, a connecting pipe 15 leading to the surface, a surface mounted blowdown selector valve 16, a barrier container 17, and a switching device 18.

The system is shown in the non-operated, or fail safe condition. The pressure vessel 12 is at approximately atmospheric pressure (14.7 psi+air pressure head due to water depth) due to the upper end of pipe 15 being connected to atmosphere by the valve 16.

The valve actuator 10 has a housing 1 accommodating a movable wall member (shown as a piston 19 in FIG. 1) separating first and second chambers 2, 3. The housing defines a port opening into the first chamber 2 and which is connected to a control port of the selector valve 11 which is operable to connect the first chamber 2 to either the source of pressure fluid 14 or, as in the illustrated condition of the system, to the interior of the pressure vessel 12. The second chamber 3 has a port 23 connected to the top of the container 17, the lower end of which is open so that chamber 3 is subject to the hydrostatic pressure of the ambient seawater i.e., the chamber 3 is in direct fluid communication with the ambient seawater. The volume V2 of the container 17 is greater than the volume V1 of the second chamber 3 so that the trapped gas volume prevents seawater entering the actuator during normal operation thereof. The piston 19 is fixed on the end of an axial stem or piston rod which is coupled to the operating member of the process valve 20 being controlled. The piston 19 is shown to be equipped with seals 21 for cooperation with internal surfaces of the housing.

The piston 19 is driven to the right under the influence of the trapped low density fluid (gas) at seawater pressure in chamber 3 and holds the product valve 20 in the closed position. The piston 19 presses the end stop abutment seal 21 against the confronting wall of the housing, thereby sealing off the pressure vessel 12 and preventing entry of surrounding seawater into the system via the barrier container 17.

When the selector valve 11 is operated, the pressure vessel 12 is sealed off from the chamber 2 and high pressure gas is admitted to the valve actuator 10, to stroke product valve 20 to the open position. Leakage of gas past the piston during its forward stroke provides gas flushing of the cylinder during the working stroke and raises the pressure in the discharge end, i.e. chamber 3, of the actuator to a level higher than the surrounding hydrostatic pressure, thereby forcing the seawater level in container 17 down until the gas can bubble freely, to the surface. The flowby gas therefore effectively maintains a gas seal between the sea and the system internals. When the actuator strokes in the opposite direction, the seawater level will rise within container 17, but will not enter the cylinder or control system. Seawater can initially be prevented from entering the actuator by fitting a blow off cap 25 which is automatically jettisoned upon pressurising the actuator and hence the container. The piston 19, at the end of its forward stroke is driven against the abutment seal 22 at the opposite end of the cylinder to prevent continuous gas leakage to sea via the barrier container 17.

Should any seawater accumulate in the bottom of the pressure vessel 12, this can be ejected directly to sea via a drain fitted with a non-return valve 13, by periodically pressurising the vessel 12, above the surrounding seawater hydrostatic pressure by operating blowdown valve 16 to connect the upper end of pipe 15 to a suitable source of gas pressure.

To shut the product valve 20, selector valve 11 is operated by switch 18, so that the gas supply 14 is isolated and the working chamber 2 of valve actuator 19 is exhausted to the surface via the pressure vessel 12 and pipe 15. The capacity of the pressure vessel 12 allows the valve to shut at a higher rate than the gas is exhausted to the surface, but the vessel is not essential and the drain port of the selector valve could be connected directly to the surface by a conduit such as pipe 15. The rate of movement of the piston is also assisted by the flowby feature which allows the piston to move through the exhausting fluid.

Figure 2:
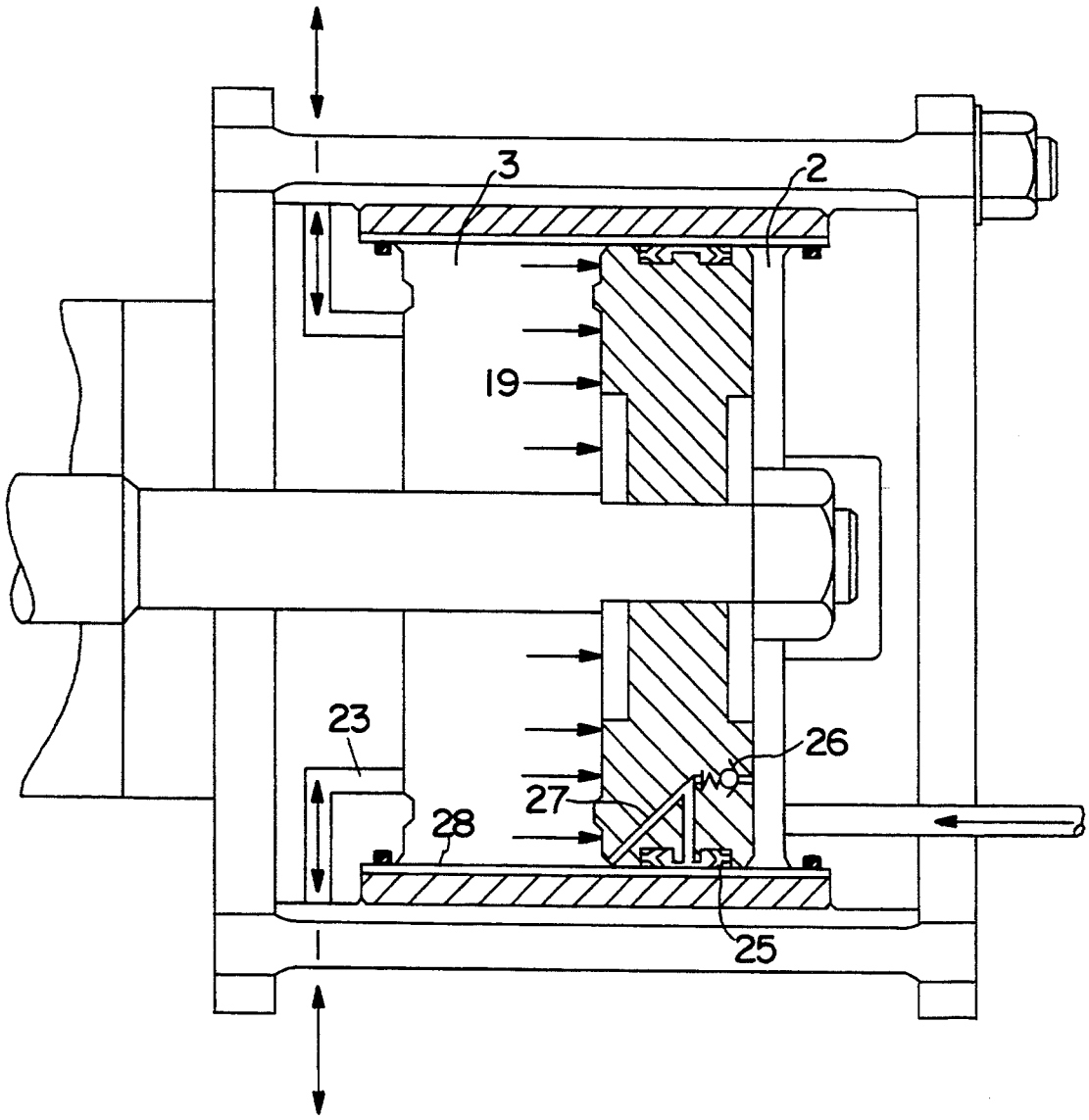
FIG. 2 illustrates in axial cross section a piston-type actuator or thrusting device.

FIG. 2 illustrates the principal features of a piston-type thrusting device (Valve Actuator) 10.

To enable the valve actuator to operate satisfactorily with untreated seawater present, the design of the actuator and the control system enable high flowby rates to provide efficient gas purging of the actuator to flush out contaminants and minimise internal biological growth. During forward movement of the piston (to the left as depicted in the drawing), fluid flow passes reverse fitted seal 25 or non-return valve 26 and is directed through a duct 27 provided in the piston near the bottom edge thereof to disturb and scavenge particulate matter on the lower internal surface 28 of the cylinder. The seal 25 and/or non-return valve 26 prevents gas flow past the piston during its reverse stroke. High bypass rates are also conducive to large operating clearances between the piston and cylinder wall thereby minimising potential seizure problems. The cylinder or housing of the actuator is shown to be formed by two end walls and a frame.

The materials of construction of the actuator will be plastic or composite materials and/or alloyed metals to minimise corrosive effects of direct seawater contact. The use of composite materials for construction can help to minimise marine biological growth as anti-biological inhibitors may be mixed with the composite materials.

Figure 3:
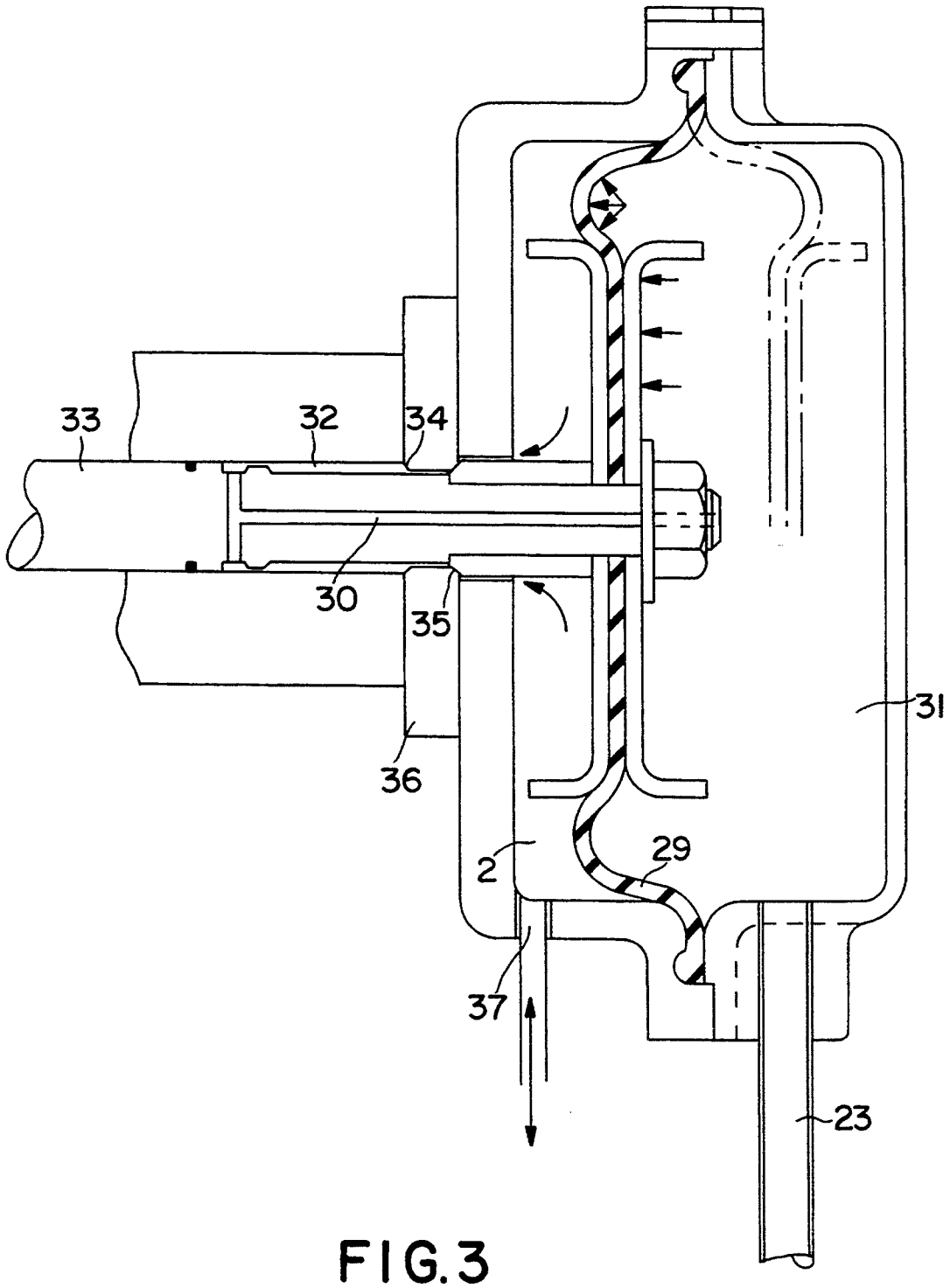
FIG. 3 illustrates in axial cross section a diaphragm type thrusting device.

FIG. 3 illustrates an alternative design of subsea actuator utilising a diaphragm 29 clamped between a pair of support plates on the piston rod or stem 33 as the thrusting member or movable wall member. This construction eliminates any sliding components within the actuator and provides a substantially frictionless arrangement. High flowby rates are achieved by a duct 30 formed in the stem 33 which provides flow to chamber 3 on the discharge side of the diaphragm via an annulus 32 around the actuator stem 33 and valve seats 34 and 35 on a seat plate 36. Corresponding seats are provided on the actuator stem 33 for cooperation with the seats 34, 35 respectively in the end positions of the stroke, so that the valve seats prevent flowby or sea return at the extreme positions of actuator travel. High pressure gas is connected to supply port 37 to operate the actuator whilst gas at hydrostatic sea bed pressure is connected to port 23 to provide the return (and "fail safe") force via barrier container 17. All other features of the subsea actuator construction regarding materials etc., will be similar to the piston type actuator described in FIG. 2, with the exception of the elastomer diaphragm 29.

Figure 4:
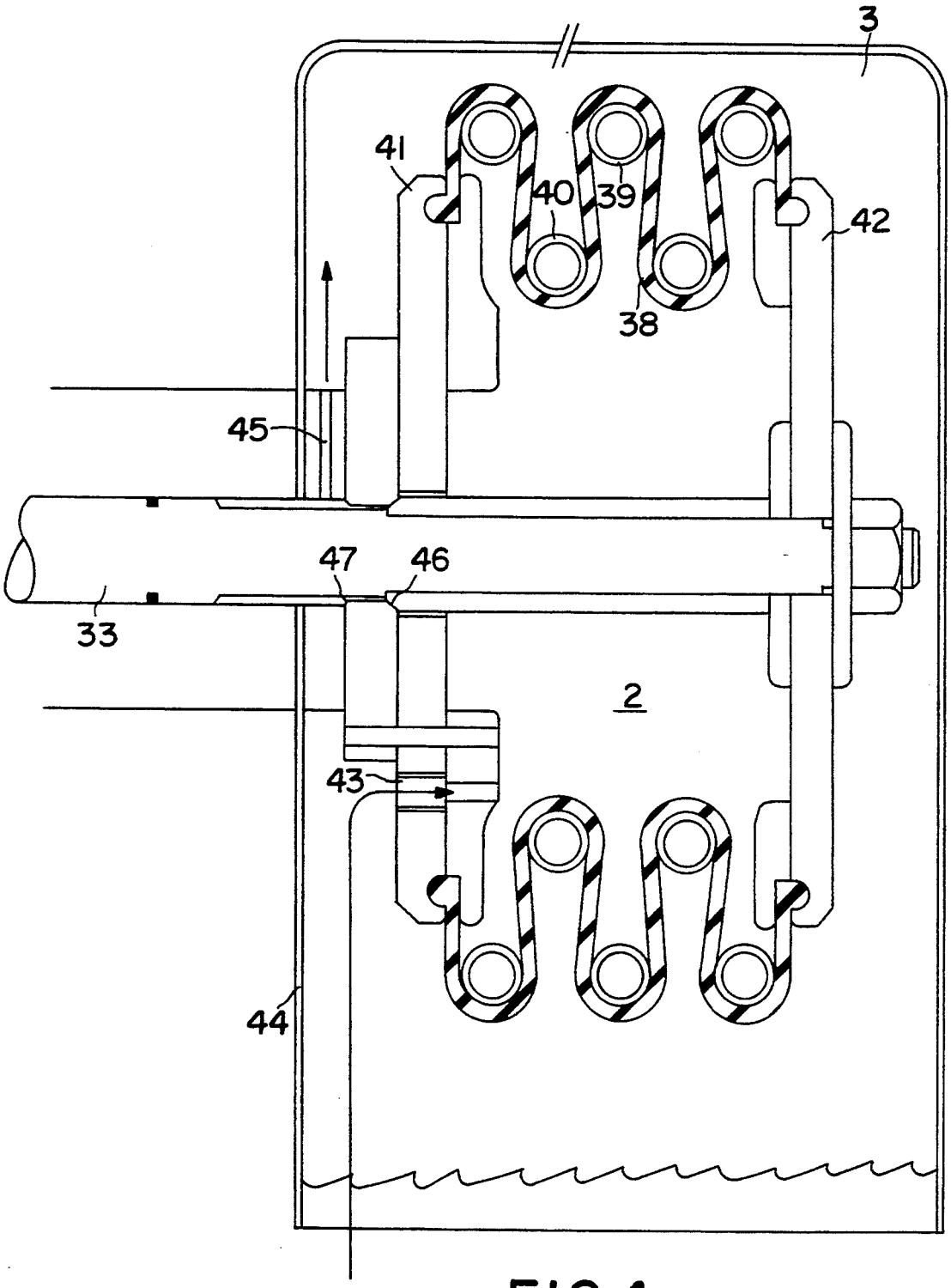
FIG. 4 illustrates in axial cross section a bellows type thrusting device.

FIG. 4 shows an alternative bellows-type actuator comprising a bellows 38 supported by internal rings 39 to prevent internal collapse and external rings 40 to prevent outward bursting. The bellows is sealed at one end to a plate 41 forming a stationary housing wall. The other end of the bellows 38 is sealed to the periphery of a plate 42 fixed to the piston rod or stem 33 and constituting a movable wall or thrusting member. When high pressure gas is connected to port 43 opening into chamber 2 within the bellows, the bellows expands axially, the plate 42 moving to the right as seen in the drawing, thereby to open the process valve 20 (not shown). Expansion of the bellows displaces gas from an opened-bottom barrier canopy 44 within which the actuator is housed and hence lowers the sea level within said canopy. During this forward working stroke, flowby gas passes into canopy 44 from chamber 3 via a port 45, such communication being interrupted at either end of the working stroke by seats 46 and 47 engaging with complementary seats on the stem 33 in a manner similar to the diaphragm actuator shown in FIG. 3. The canopy is suitably sized to ensure the sea level is maintained below the contact level of the actuator under all conditions.

When the port 43 is connected to atmospheric pressure by operation of the selector valve, the actuator strokes in the reverse direction to the position shown in the drawing under the pressure, namely the hydrostatic pressure of the ambient sea water, acting on the outer face of plate 42.

Figure 5:
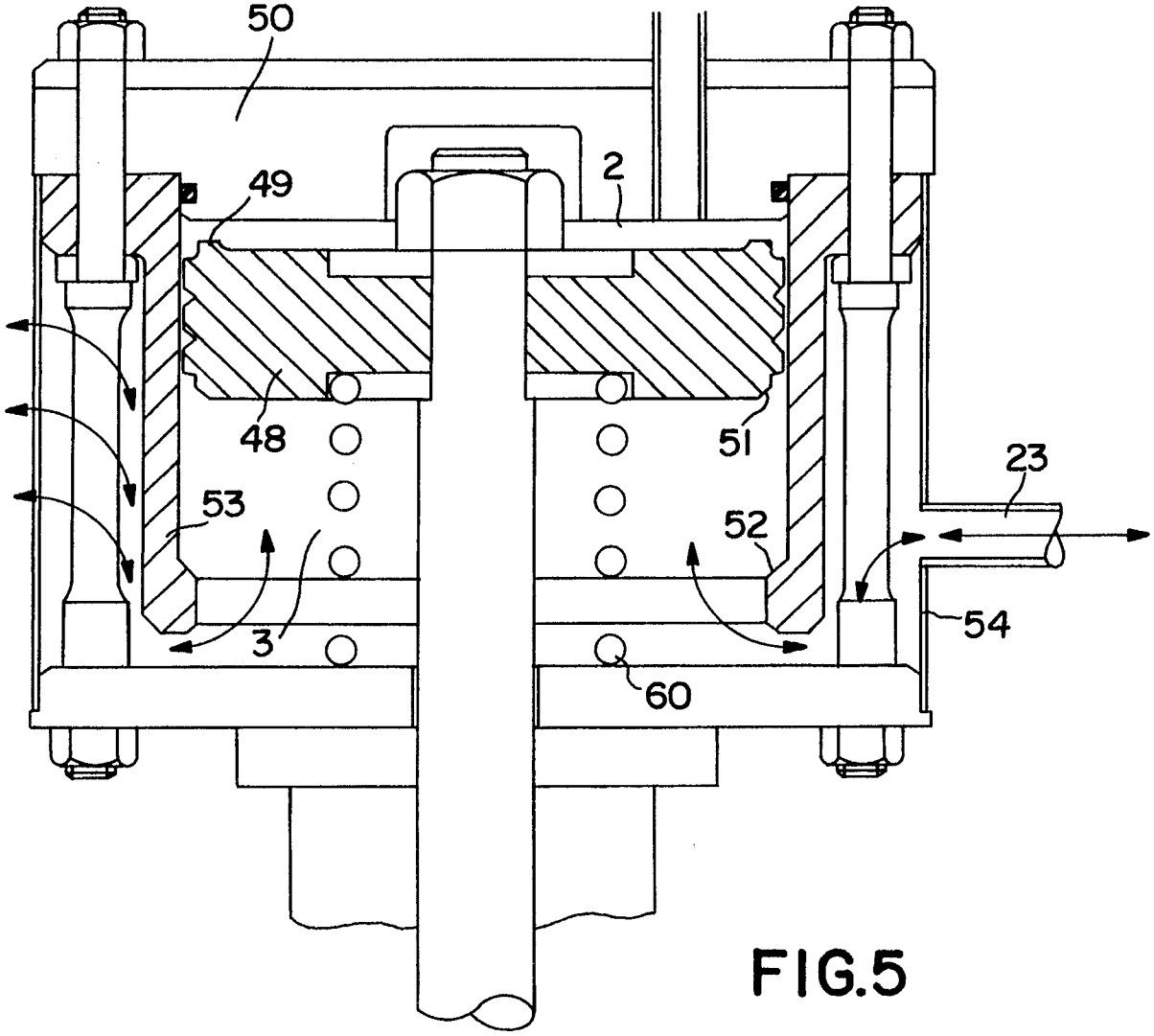
FIG. 5 illustrates in axial cross section an alternative piston type thrusting device.

FIG. 5 shows an alternative piston actuator arrangement wherein a high flowby rate is achieved by a sealless piston 48. Optionally a seal ring 49 integral with the piston engages the cylinder end wall 50 to prevent flowby at one end of the piston stroke. At the other end, a seat 51 on the piston contacts a seat 52 situated on an inwardly directed lip at the otherwise open end of the cylinder. This arrangement minimises the corners and crevices in which particulate matter may accumulate in the functioning parts of the actuator. An outer case 54 is provided to collect and transfer gas to a barrier container 17 via a port 23 as previously described. Alternatively, in place of the case 54 a coarse filter screen may be applied so that the chamber 3 is in direct communication with the ambient seawater.

The materials of construction would be similar to piston type actuator previously described and shown in FIG. 2.

Figure 6:
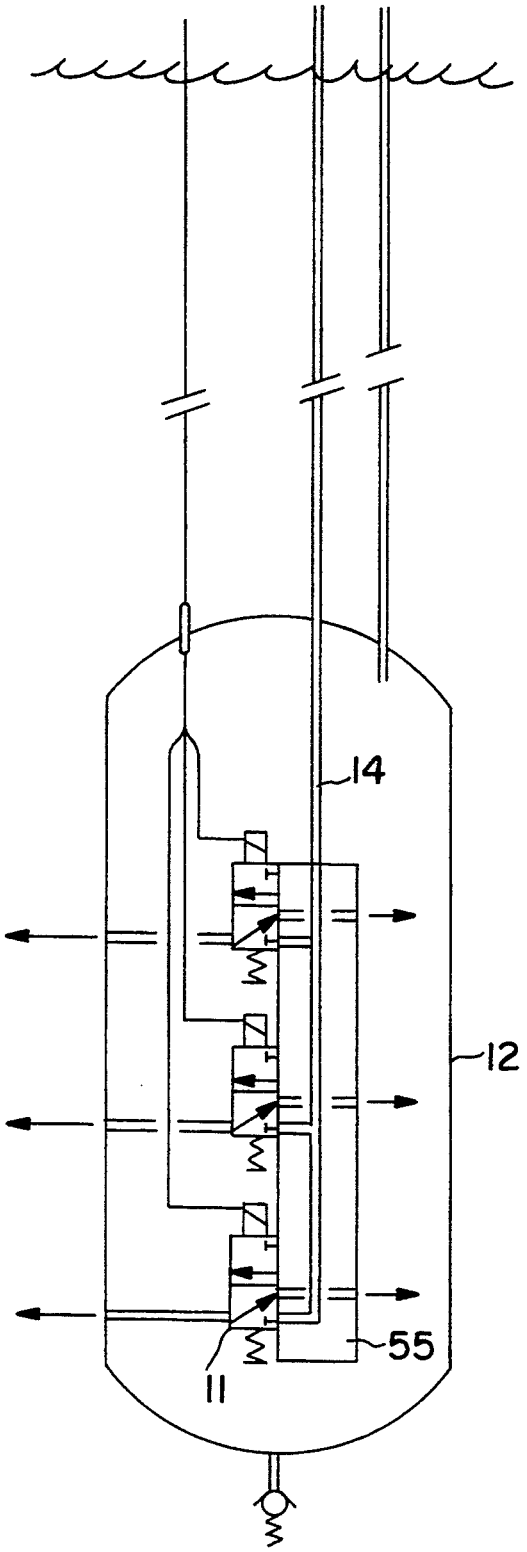
FIG. 6 shows a schematic layout of a pressure vessel containing one or more control valves.

FIG. 6 shows a schematic arrangement of the pressure vessel containing one or more selector valves 11, for the operation of one or more product valves 20. The selector valves (for multiple systems) would comprise a common manifold 55, mounted and connected to a common pressurised gas supply 14, and would exhaust into the same pressure vessel 12.

The pressure vessel could be arranged for modular replacement for maintenance although it is not envisaged that it will be necessary with selector valves 11, specifically designed for the system conditions.

The control system and actuators specifically described hereinabove have pressurised gas as the power medium. However, other sources of fluid under pressure may be used and in particular local sources of pressurised fluid available at the seabed could be utilised. Thus, the well stream 70 to which the process valve 20 is fitted energy of the could be employed, as indicated by a connecting pipe 71 depicted in broken line in FIG. 1. In addition, seawater raised to a suitable operating pressure by a pump 75 (FIG. 1) mounted at the seabed can be used as the power medium. If seawater is used as the power medium, certain modifications will be appropriate to the system and the actuators disclosed. Thus, the pressure vessel 12 and pipe 15 may be omitted, the selector valve then being arranged for connecting the chamber 2 of the actuator to a drain leading directly into the sea. In order to provide a return force on the movable wall member when it is subjected on both sides to the hydrostatic pressure of ambient seawater, a spring, such as the coil spring as shown for exemplary purposes in FIG. 5, may be included within the actuator. Of course it will be appreciated that the actuators shown in the other drawings can be equipped with equivalent return springs.

In addition, when operating with raw sea water, the barrier container 17 is obviated and the actuator may be constructed so that chamber 3 opens directly to the ambient seawater, which can help to facilitate the expulsion of foreign matter from within the actuator.

I claim:

1. A subsea actuator for operating a subsea component such as a valve, comprising a housing, a movable wall member cooperating with the housing to confine therewith a substantially closed chamber separated by the movable wall member from another fluid space, the wall member being fastened to an elongate output member and being movable under forces acting against opposite sides thereof to displace the output member longitudinally, and inlet means to connect said chamber to either a source of pressurised fluid at a pressure greater than the hydrostatic pressure of the ambient seawater, or to a drain outlet at a pressure not greater than the hydrostatic pressure of the ambient seawater, said actuator being arranged for said other space to be in direct fluid communication with and thereby at the hydrostatic pressure of ambient seawater and said movable wall to be moved in a forward direction when the chamber is connected to the source of pressure fluid and to be moved in a reverse direction when the chamber is connected to the drain outlet.

2. An actuator according to claim 1, wherein the other space is another chamber defined within said housing.

3. An actuator according to claim 1, wherein the wall member is movable between opposed forward and rear end positions defined by stop faces fixed relative to the housing.

4. An actuator according to claim 3, wherein means is provided to allow pressurised fluid to pass from said chamber to said other space during movement thereof from said rear end position to said forward end position.

5. An actuator according to claim 1, wherein the wall member is a piston and the housing defines a cylinder accommodating the piston.

6. An actuator according to claim 4, wherein the wall member is a piston, the housing defines a cylinder accommodating the piston, and said means comprises a clearance between the piston and cylinder.

7. An actuator according to claim 4, wherein the wall member is a piston, the housing defines a cylinder accommodating the piston, and said means comprises a duct in the piston and a one-way flow device to permit flow through the duct from said chamber.

8. An actuator according to claim 1, wherein the wall member comprises a diaphragm having an outer periphery sealed to the housing.

9. An actuator according to claim 4, wherein the wall member comprises a diaphragm having an outer periphery sealed to the housing and said means comprises a duct formed in the output member.

10. An actuator according to claim 1, wherein the movable wall member is sealed to one end of a bellows, the other end of the bellows is sealed to a stationary housing wall, and said chamber (2) is confined within said bellows.

11. An actuator according to claim 4, wherein the movable wall member is sealed to one end of a bellows, the other end of the bellows is sealed to a stationary housing wall, said chamber is confined within said bellows, and said means comprise a passage defined between said housing wall and said output member.

12. An actuator according to claim 6, wherein at least one of said stop faces defines a seal for closing off communication between said chamber and said other space (3) in the forward end position of the wall member.

13. An actuator according to claim 6, wherein the output member or wall member is provided with opposed sealing faces for cooperation with said stop faces to interrupt communication between the chamber and space (3) in the respective end positions of the wall member.

14. An actuator according to claim 1, in combination with valve means connected to the inlet means and operable to connect the chamber to a source of seawater under pressure or to a drain outlet opening into the seawater.

15. An actuator according to claim 1, in combination with first valve means connected to the inlet means and operable to connect the chamber to a natural source of fluid under pressure or to a drain outlet.

16. An actuator according to claim 1, in combination with first valve means connected to the inlet means and operable to connect the chamber to a source of pressurized gas (14) or to a conduit connected to atmospheric pressure.

17. An actuator according to claim 16, wherein the conduit includes a non-return dump valve controlling an outlet opening into the sea, and the upper end of the conduit is connected to a second valve means operable to connect the conduit to a source of gas under pressure for pressurising the conduit to discharge liquid from the conduit.

18. An actuator according to claim 17, wherein the first valve means has a drain outlet connected to a pressure vessel, and the pressure vessel is provided with the outlet and dump valve.

19. An actuator according to claim 1, including a hollow open bottomed container (17) connected to the actuator for trapping a volume of gas therein, and said other space of the actuator is in direct fluid communication with ambient seawater through the container, the hydrostatic pressure of the ambient seawater being transmitted to said space by the gas trapped in said container.

20. An actuator according to claim 19, including a closure for temporarily closing the container bottom, said closure being removable by pressurisation of the container via the actuator.

21. An actuator according to claim 19, wherein said other space is enclosed within the housing and connected through a port to the container, and the volume of the container is greater than the difference between the maximum and minimum volumes of said other space.

* * * * *

UNITED STATES PATENT AND TRADEMARK OFFICE

CERTIFICATE OF CORRECTION

PATENT NO. : 5,357,999

DATED : October 25, 1994

INVENTOR(S) : William D. LOTH et al.

It is certified that error appears in the above-identified patent and that said Letters Patent is hereby corrected as shown below:

On title page, item

[73] Assignee: W. D. Loth & Co. Ltd.
Horsham, England

Signed and Sealed this

Twenty-fifth Day of April, 1995

*Attest:*

Bruce Lehman

BRUCE LEHMAN

*Attesting Officer*

*Commissioner of Patents and Trademarks*